US011033072B2

(12) United States Patent
Oda

(10) Patent No.: US 11,033,072 B2
(45) Date of Patent: Jun. 15, 2021

(54) SOLE STRUCTURE AND SHOE INCLUDING THE SOLE STRUCTURE

(71) Applicant: Mizuno Corporation, Osaka (JP)

(72) Inventor: Takao Oda, Osaka (JP)

(73) Assignee: Mizuno Corporation, Osaka (JP)

( * ) Notice: Subject to any disclaimer, the term of this patent is extended or adjusted under 35 U.S.C. 154(b) by 60 days.

(21) Appl. No.: 16/571,830

(22) Filed: Sep. 16, 2019

(65) Prior Publication Data

US 2020/0093220 A1 Mar. 26, 2020

(30) Foreign Application Priority Data

Sep. 20, 2018 (JP) ..... JP2018-176353

(51) Int. Cl.
*A43B 3/24* (2006.01)
*A43B 13/16* (2006.01)
*A43B 3/26* (2006.01)

(52) U.S. Cl.
CPC ..... *A43B 13/16* (2013.01); *A43B 3/24* (2013.01); *A43B 3/26* (2013.01)

(58) Field of Classification Search
CPC ..... A43B 3/24; A43B 3/26
USPC ..... 36/97
See application file for complete search history.

(56) References Cited

U.S. PATENT DOCUMENTS 3,389,481 A * 6/1968 England ..... A43B 3/30 36/97
5,682,687 A * 11/1997 Arai ..... A43B 3/26 36/112
7,314,222 B2 * 1/2008 Borel ..... A43B 5/005 280/11.26
2003/0131501 A1 * 7/2003 Erickson ..... A43B 3/0078 36/127
2004/0107604 A1 * 6/2004 Ha ..... A43B 3/26 36/97
2007/0011916 A1 * 1/2007 Olivieri ..... A43B 3/30 36/97
2007/0151123 A1 * 7/2007 Cavasin ..... A43B 1/0018 36/10
2008/0296871 A1 * 12/2008 Hsieh ..... A43B 5/1608 280/607
2013/0333244 A1 * 12/2013 Rosen ..... A43B 3/26 36/97
2015/0059204 A1 * 3/2015 Alexander ..... A43B 3/26 36/44

FOREIGN PATENT DOCUMENTS

JP 2008517699 A 5/2008

* cited by examiner

*Primary Examiner* — Marie D Bays
(74) *Attorney, Agent, or Firm* — Troutman Pepper Hamilton Sanders LLP; James E. Schutz; Micah B. Hensley

(57) ABSTRACT

In a sole structure of a shoe, each of a first sole portion and a second sole portion is configured such that a first sole body and a second sole body come close to each other and are separated from each other at least in the foot length direction while maintaining a state in which a first connection portion and a second connection portion overlap each other in a vertical direction.

6 Claims, 14 Drawing Sheets

SOLE STRUCTURE AND SHOE INCLUDING THE SOLE STRUCTURE

CROSS-REFERENCE TO RELATED APPLICATION

This application claims priority to Japanese Patent Application No. 2018-176353 filed on Sep. 20, 2018, the entire disclosure of which is incorporated by reference herein.

BACKGROUND

The present disclosure relates to a sole structure and a shoe including the sole structure.

Conventionally, for example, a sole structure descried in Japanese Translation of PCT International Application No. 2008-517699 has been proposed as a sole structure that supports a foot of a person (which will be hereinafter referred to as a "wearer") who wears shoes.

In Japanese Translation of PCT International Application No. 2008-517699, a sole structure including at least one shoe bottom layer including a toe portion, a heel portion, and an intermediate portion is disclosed. The intermediate portion has a plurality of opening portions that have been formed so as to vertically pass therethrough. The intermediate portion is elastically flexible such that, due to the plurality of opening portions, a thickness of the layer does not change and a length of the layer changes in the intermediate portion. Each of the toe portion and the feel portion is relatively displaceable with respect to the intermediate portion in a longitudinal direction (that is, a foot length direction).

SUMMARY

In the sole structure of Japanese Translation of PCT International Application No. 2008-517699, each of the toe portion and the heel portion is relatively displaceable with respect to the intermediate portion in the foot length direction due to the intermediate portion including the plurality of opening portions. Thus, it is possible to appropriately change the length in the foot length direction in the sole structure in accordance with a size of the foot of the wearer. However, in the above described sole structure, a foreign matter, water, or the like easily enters the sole structure through the plurality of opening portions from a road surface or a ground. As a result, a problem arises in which the wearer cannot safely and comfortably wear shoes having the above described sole structure.

In view of the foregoing, the present disclosure has been devised and it is therefore an object of the present disclosure to make it possible to appropriately change a length of a sole structure at least in a foot length direction mainly in accordance with a size of a foot of a wearer while preventing entry of a foreign matter or the like.

To achieve the above described object, according to a first aspect of the present disclosure, provided is a sole structure for shoes, including a first sole portion, and a second sole portion arranged behind the first sole portion. The first sole portion includes a first sole body and a first connection portion provided in a rear portion of the first sole body. The second sole portion includes a second sole body and a second connection portion that is provided in a front portion of the second sole body and is connected to the first connection portion so as to overlap the first connection portion in a vertical direction. Each of the first sole portion and the second sole portion is configured such that the first sole body and the second sole body come close to each other and are separated from each other at least in the foot length direction while maintaining a state in which the first connection portion and the second connection portion overlap each other in the vertical direction.

In the first aspect, the first sole body and the second sole body come close to each other and are separated from each other at least in the foot length direction, and therefore, a length of the sole structure at least in the foot length direction can be appropriately changed mainly in accordance with a size of a foot of a wearer. Also, the state in which the first connection portion and the second connection portion overlap each other in the vertical direction is maintained, and therefore, in particular, even when the first sole body and the second sole body are separated from each other in the foot length direction, a gap between the first sole body and the second sole body hardly occurs. Therefore, a foreign matter, water, or the like hardly enters the sole structure from the road surface or the ground. Accordingly, in the first aspect, entry of a foreign matter or the like can be prevented and also the length of the sole structure at least in the foot length direction can be appropriately changed mainly in accordance with the size of the foot of the wearer.

According to a second aspect, in the first aspect, at least one connection shaft that protrudes in the vertical direction is provided in one of the first connection portion and the second connection portion, and the first connection portion and the second connection portion are connected to each other via the connection shaft so as to overlap each other in the vertical direction and are configured to relatively move with respect to each other at least in the foot length direction.

In the second aspect, the first connection portion and the second connection portion are connected to each other via the connection shaft so as to overlap each other in the vertical direction and are configured to relatively move with respect to each other at least in the foot length direction, and therefore, it is easy to achieve a configuration in which the first sole body and the second sole body come close to each other and are separated from each other at least in the foot length direction while maintaining the state in which the first connection portion and the second connection portion overlap each other in the vertical direction. With the above described simple configuration, similar working effects to those of the first aspect can be achieved.

According to a third aspect, in the second aspect, only one said connection shaft is provided, and each of the first connection portion and the second connection portion is configured to turn in a foot width direction about the connection shaft as a turning shaft.

In the third aspect, each of the first connection portion and the second connection portion is configured to turn in a foot width direction about the connection shaft as a turning shaft, and therefore, one of the first sole body and the second sole body relatively moves with respect to the other one of the first sole body and the second sole body also in the foot width direction. Thus, a relative positional relationship between the first sole body and the second sole body is not limited by a size of foot of wearer and can be adapted to various operations of the foot of the wearer.

According to a fourth aspect, in the first aspect, an upper surface of the first sole body, an upper surface of the second sole body, and an upper surface of one of the first connection portion and the second connection portion are formed as a foot sole support surface that supports a sole of a foot of a wearer. The upper surface of one of the first connection portion and the second connection portion is flush with the upper surface of each of the first sole body and the second sole body.

In the fourth aspect, the foot sole support surface formed of the upper surface of the first sole body, the upper surface of the second sole body, and the upper surface of one of the first connection portion and the second connection portion can be entirely made smooth. As a result, the wearer does not feel discomfort in the sole of the foot and also the sole of the foot of the wearer can be stably supported.

According to a fifth aspect, in the first aspect, the first connection portion is arranged under the second connection portion, and an outsole is stacked on a lower side of the first connection portion.

In the fifth aspect, with the outsole stacked on the lower side of the first connection portion, entry of a foreign matter, water, or the like in the sole structure through the first connection portion from the road surface or the ground can be prevented.

According to a sixth aspect, in the first aspect, the second connection portion is arranged under the first connection portion, and an outsole is stacked on a lower side of the second connection portion.

In the sixth aspect, with the outsole stacked on the lower side of the second connection portion, entry of a foreign matter, water, or the like in the sole structure through the second connection portion from the road surface or the ground can be prevented.

According to a seventh aspect, a shoe including the sole structure of the first aspect is provided.

In the seventh aspect, a pair of shoes that exhibit similar working effects to those of the first aspect can be achieved. The wearer can safely and comfortably wear the shoes.

According to an eighth aspect, in the seventh aspect, the shoe further includes an upper attached to the sole structure. The upper includes an extensible and contractible elastic portion arranged in a position that corresponds to a position in which the first connection portion and the second connection portion overlap each other in the vertical direction, a first fixed portion arranged in front of the first connection portion and firmly fixed to the first sole body, and a second fixed portion arranged behind the second connection portion and firmly fixed to the second sole body.

In the eighth aspect, when the wearer wears the shoes, the elastic portion of the upper extends and contracts in accordance with the size of the foot of the wearer and at least one of the first fixed portion and the second fixed portion moves in the foot length direction. Due to this movement, at least one of the first sole body and the second sole body moves in the foot length direction and the first connection portion and the second connection portion relatively move with respect to each other in the foot length direction. As described above, the length of the sole structure at least in the foot length direction can be adapted to change of a shape of the upper. As a result, the entire shoe can be made to fit mainly the size of the foot of the wearer.

As described above, according to the present disclosure, entry of a foreign matter or the like can be prevented and also a length of a sole structure at least in the foot length direction can be appropriately changed mainly in accordance with a size of a foot of a wearer.

DETAILED DESCRIPTION

Embodiments of the present disclosure will now be described in detail with reference to the drawings. The following description of the embodiments are mere examples by nature, and are not intended to limit the scope, application, or uses of the present disclosure.

Figure 1:
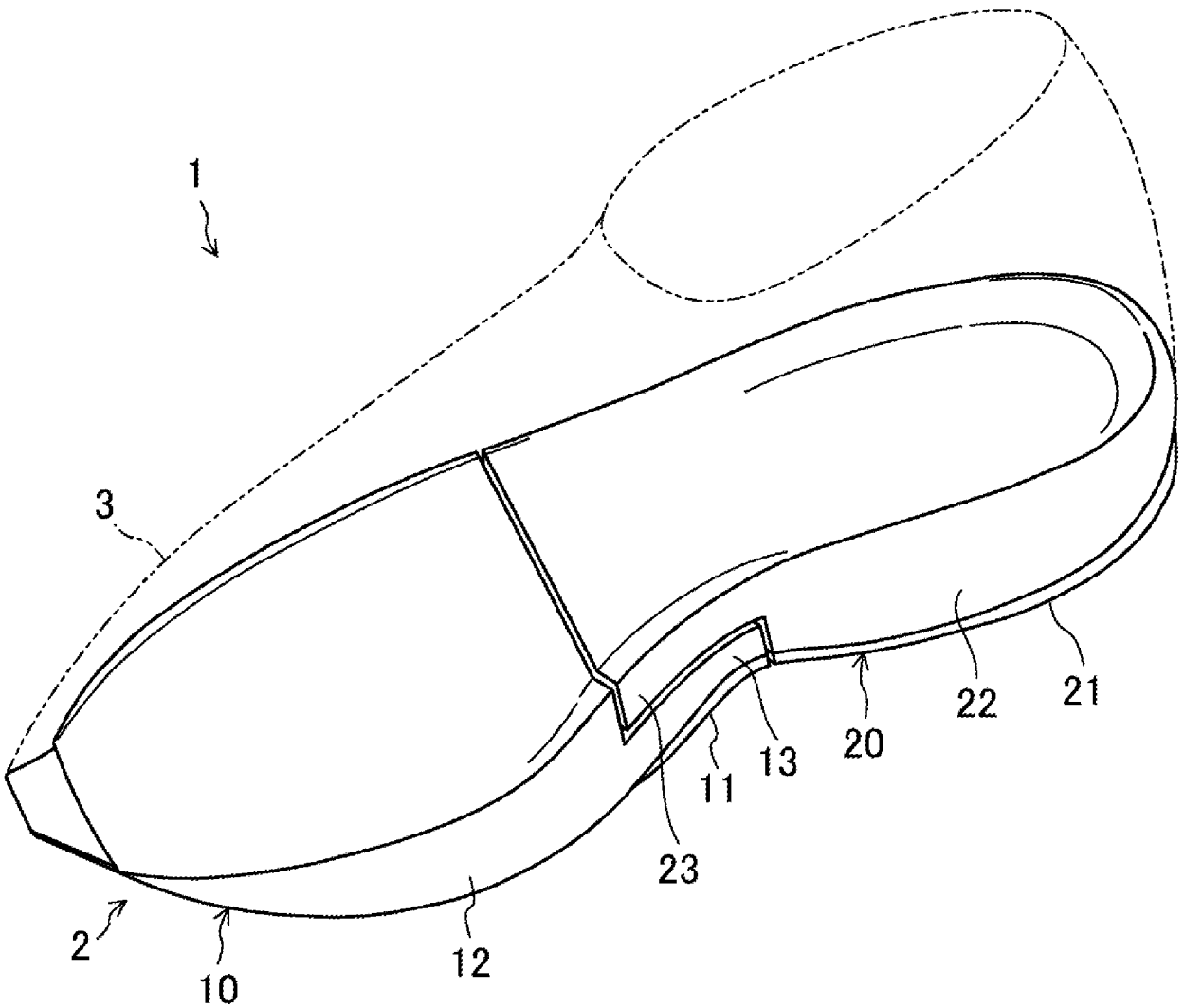
FIG. 1 is an overall perspective view of an entire shoe including a sole structure according to an embodiment.
Figure 2:
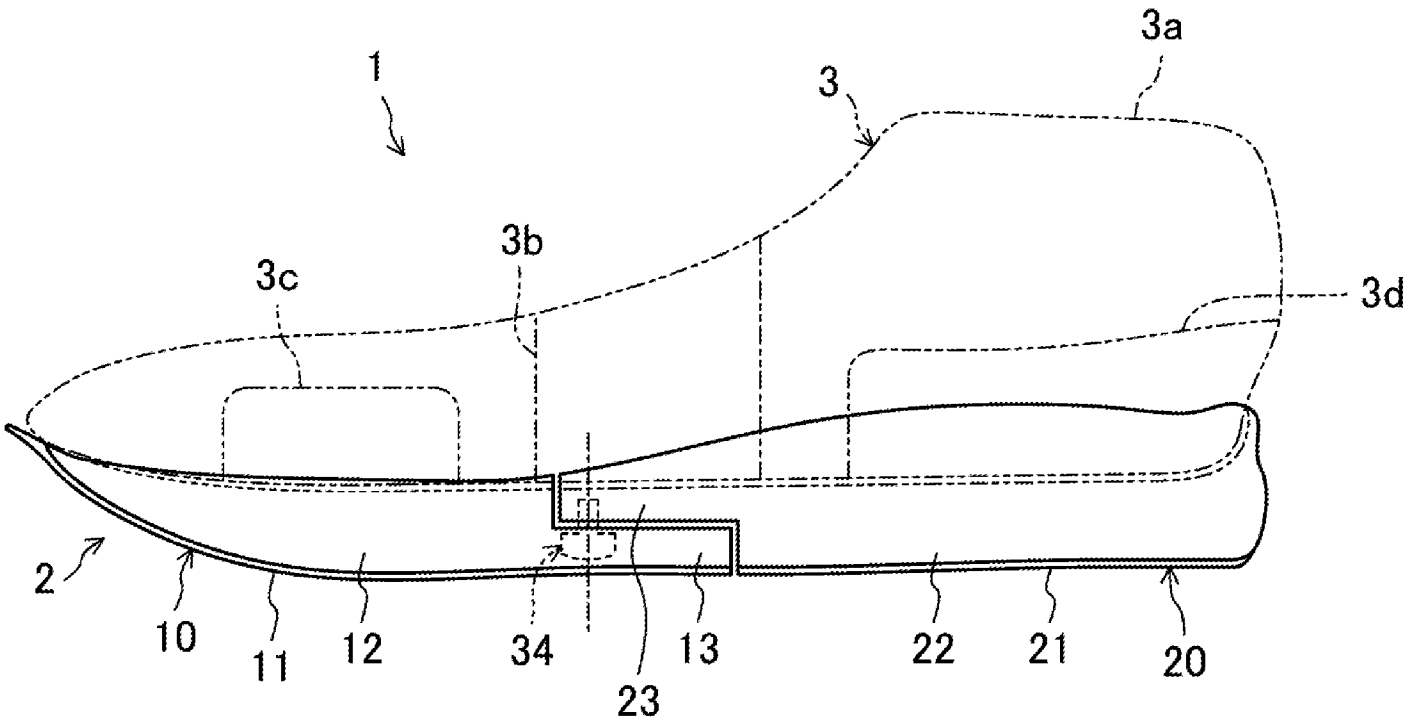
FIG. 2 is a side view of the shoe including the sole structure according to the embodiment when viewed from a medial side.
Figure 3:
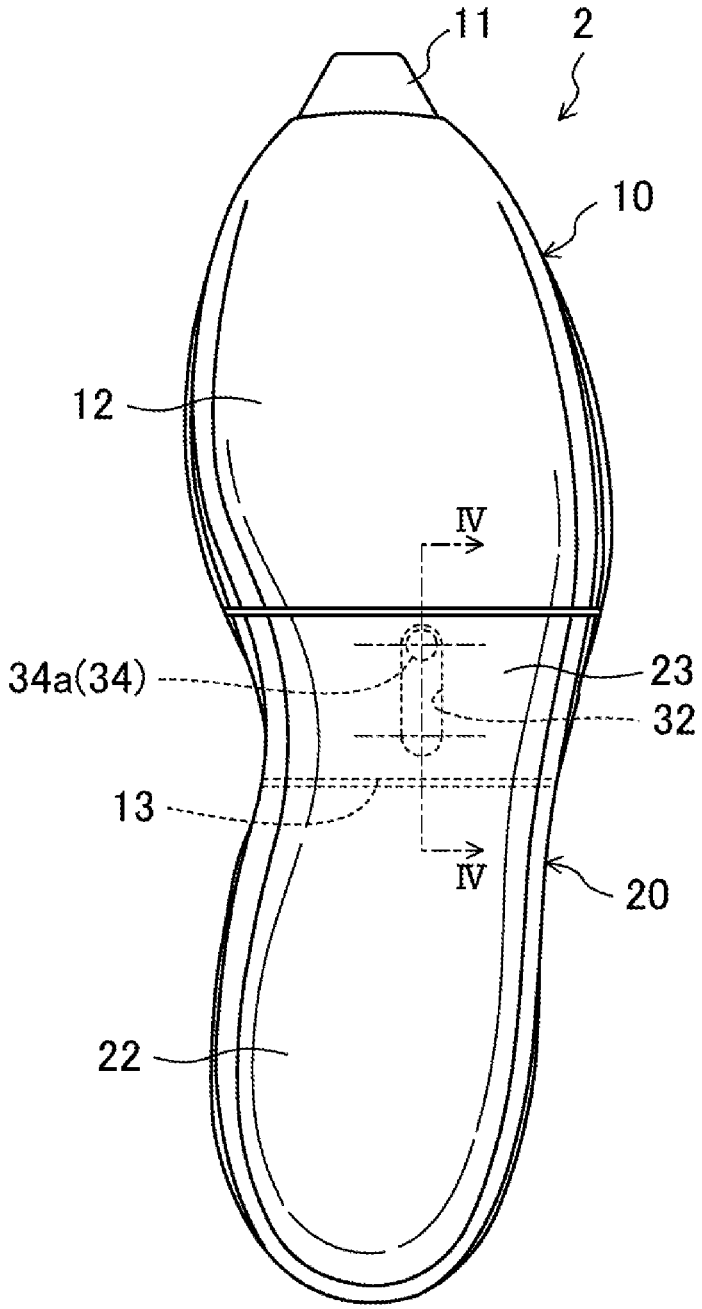
FIG. 3 is a plan view of the sole structure according to the embodiment.

FIGS. 1 to 3 illustrate a sole structure 2 according to an embodiment of the present disclosure and a shoe 1 including the sole structure 2. A pair of the shoes 1 can be used, for example, as athletic shoes for running and various sports, sneakers for daily use, or rehabilitation shoes.

Only right shoe of the pair of shoes 1 is described herein as an example. Since a left shoe is symmetrical to the right shoe, only the right shoe will be described in the following description, and the description of the left shoe will be omitted herein.

In the following description, the expressions "upper side" and "lower side" represent the vertical positional relationship between respective portions of the shoe 1, the expressions "front (fore)" and "rear (hind)" represent the positional relationship between respective portions of the shoe 1 in the foot length direction (a longitudinal direction), and the expressions "medial side" and "lateral side" represent the positional relationship between respective portions of the shoe 1 in a foot width direction of the shoe 1.

As illustrated in FIGS. 1 to 4, in this embodiment, the sole structure 2 is divided into two portions in the foot length direction. Specifically, the sole structure 2 includes a first sole portion 10 and a second sole portion 20.

(First Sole Portion)

The first sole portion 10 is arranged, for example, so as to correspond to a range from a forefoot to a midfoot of a foot of a person (which will be herein after referred to as a "wearer") who wears the shoe 1.

The first sole portion 10 includes a first outsole portion 11. The first outsole portion 11 is made of a hard elastic member having a higher hardness than those of a first sole body 12 and a first connection portion 13, which will be described later. Specifically, for the first outsole portion 11, for example, thermoplastic resin, such as ethylene-vinyl acetate copolymer (EVA) or the like, thermosetting resin, such as polyurethane (PU) or the like, or a rubber material, such as butadiene rubber, chloroprene rubber, or the like, is suitable.

Figure 5:
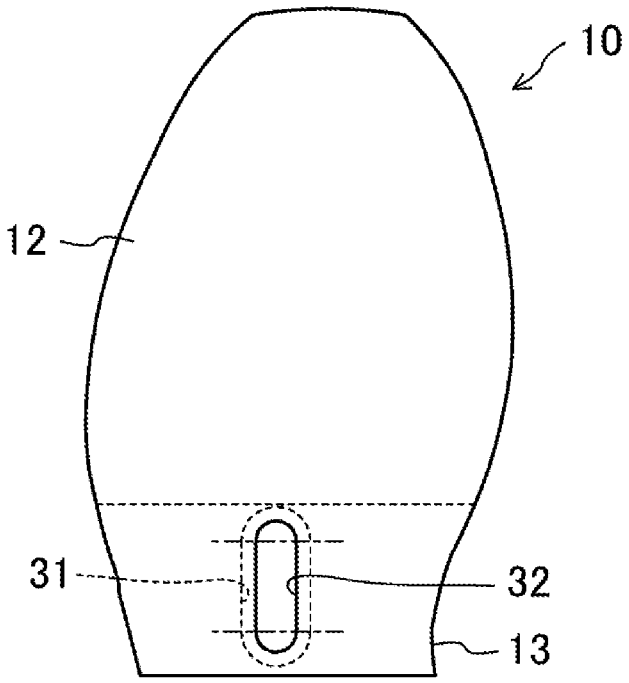
FIG. 5 is a bottom view of a first sole portion.

As illustrated in FIG. 5, the first sole portion 10 includes the first sole body 12. The first sole body 12 is stacked on an upper side of the foot sole support surface 11. The first sole body 12 is made of a soft elastic material. Specifically, for the first sole body 12, thermoplastic synthetic resin, such as ethylene-vinyl acetate copolymer (EVA) or the like, foam thereof, thermosetting resin, such as polyurethane (PU) or the like, foam thereof, a rubber material, such as butadiene rubber, chloroprene rubber, or the like, foam thereof, or the like is suitable.

An upper surface of the first sole body 12 is formed as a portion of a foot sole support surface that supports a range from the forefoot to the midfoot in the sole of the foot of the wearer.

As illustrated in FIGS. 1 to 5, the first sole portion 10 includes a first connection portion 13. The first connection portion 13 is made of the same material as that of the first sole body 12. The first connection portion 13 is provided in a rear portion of the first sole body 12. The first connection portion 13 is integrally formed with the first sole body 12. The first connection portion 13 is arranged under a second connection portion 23, which will be described later. Similar to the first sole body 12, the first connection portion 13 is stacked on an upper side of the first outsole portion 11.

The first connection portion 13 is formed so as to have a smaller thickness than that of the first sole body 12. The first connection portion 13 is formed in a stepped shape with respect to the upper surface of the first sole body 12 in a side view. Specifically, an upper surface of the first connection portion 13 is located below the upper surface of the first sole body 12. A lower surface of the first connection portion 13 is flush with a lower surface of the first sole body 12.

Figure 4:
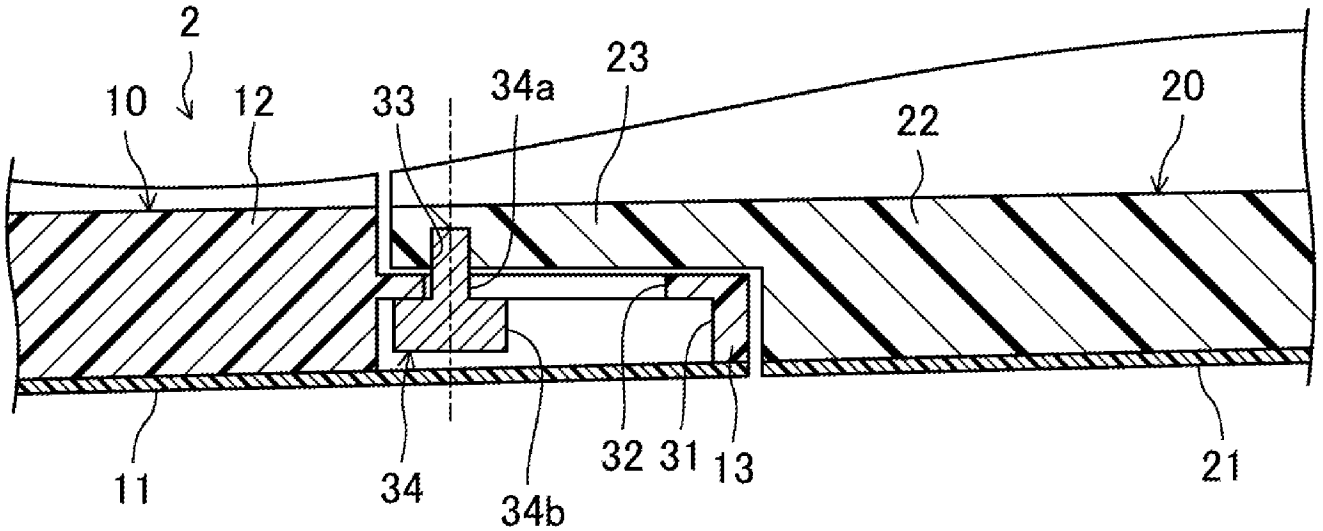
FIG. 4 is a cross-sectional view taken along the line IV-IV in FIG. 3.

As illustrated in FIGS. 4 and 5, a guide 31 is provided in the first connection portion 13. The guide 31 movably guides a connecting shaft 34, which will be described later, in the foot length direction. The guide 31 is formed so as to be recessed in a groove shape upwardly from the lower surface of the first connection portion 13. The guide 31 is formed so as to be longer in the foot length direction than in the foot width direction. The guide 31 is arranged substantially in a center in the foot width direction in the first connection portion 13. The guide 31 is covered by the first outsole portion 11 from below such that an inner space is sealed (see FIG. 4).

The guide 31 has a through hole 32 that passes through in a vertical direction in a bottom portion of the guide 31. The through hole 32 is provided such that a shaft portion 34*a* of the connecting shaft 34, which will be described later, passes through the through hole 32 in the vertical direction. The through hole 32 is arranged substantially in a center in the foot width direction in the guide 31. The through hole 32 is formed so as to be longer in the foot length direction than in the foot width direction. The through hole 32 is formed such that a width of the through hole 32 in the foot width direction is larger than a diameter of the shaft portion 34*a* of the connecting shaft 34. The through hole 32 is also formed such that the width of the through hole 32 in the foot width direction is smaller than a diameter of a stopper 34*b* of the connecting shaft 34, which will be described later.

(Second Sole Portion)

As illustrated in FIGS. 1 to 4, the second sole portion 20 is arranged behind the first sole portion 10. The second sole portion 20 is arranged, for example, so as to correspond to a range from the midfoot of the foot of the wearer to a hindfoot of the foot.

The second sole portion 20 includes a second outsole portion 21. Similar to the first outsole portion 11, the second outsole portion 21 is made of a hard elastic member having a high hardness. Note that the second outsole portion 21 may be made of the same material as a material of the first outsole portion 11. As another option, the second outsole portion 21 may be made of a different material from the material of the first outsole portion 11.

Figure 6:
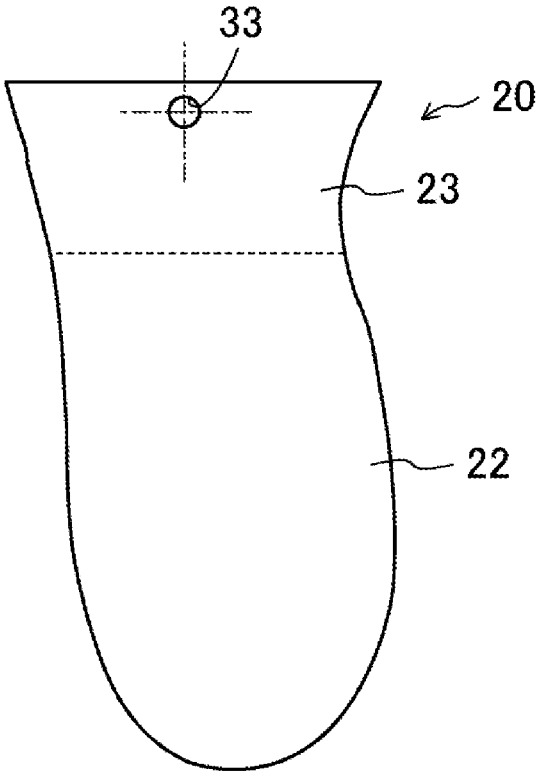
FIG. 6 a bottom view of a second sole portion.

As illustrated in FIG. 6, the second sole portion 20 includes a second sole body 22. Similar to the first sole body 12, the second sole body 22 is made of a soft elastic material. Note that the second sole body 22 may be made of the same material as a material of the first sole body 12. As another option, the second sole body 22 is made of a different material from the material of the first sole body 12.

The second sole body 22 is stacked on an upper side of the second outsole portion 21. The upper side of the second sole body 22 is formed as a portion of the foot sole support surface that supports a range from the midfoot to the hindfoot in the sole of the foot of the wearer.

The second sole portion 20 includes the second connection portion 23. The second connection portion 23 is provided in a front portion of the second sole body 22. The second connection portion 23 is integrally formed with the second sole body 22. Note that the second connection portion 23 may be made of the same material as a material of the first connection portion 13. As another option, the second connection portion 23 is made of a different material from the material of the first connection portion 13.

The second connection portion 23 is formed so as to have a smaller thickness than a thickness of the second sole body 22. The second connection portion 23 is formed in a stepped shape with respect to the lower surface of the second sole body 22 in a side view. Specifically, a lower surface of the second connection portion 23 is located above the lower surface of the second sole body 22. An upper surface of the second connection portion 23 is flush with the upper surface of the first sole body 12 and an upper surface of the second sole body 22. That is, the upper surface of the second connection portion 23 is formed as a portion of the foot sole support surface that supports a portion of the sole of the foot of the wearer.

As illustrated in FIG. 6, a fixing hole 33 is provided in the second connection portion 23. The fixing hole 33 is formed upward from the lower surface of the second connection portion 23 so as to be a bottomed hole. The fixing hole 33 is formed so as to have a circular shape in a bottom view. The fixing hole 33 is arranged close to a front edge of the second connection portion 23. The fixing hole 33 is arranged substantially in a center in the foot width direction in the second connection portion 23.

As illustrated in FIGS. 2 and 3, the connecting shaft 34 is provided in the second connection portion 23. As illustrated in FIG. 4, the connecting shaft 34 includes the shaft portion 34*a* and the stopper 34*b*.

The shaft portion 34*a* is formed so as to have a columnar shape that extends in the vertical direction. In this embodiment, the shaft portion 34*a* is formed to have a cylindrical shape. A lower portion of the shaft portion 34*a* is inserted in the through hole 32 of the first connection portion 13. An upper portion of the shaft portion 34*a* is firmly fixed in the fixing hole 33 of the second connection portion 23, for example, with an adhesive.

The stopper 34*b* is formed so as to have, for example, a substantially disk shape. The stopper 34*b* is formed so as to have a larger diameter than a diameter of the shaft portion 34*a*. The stopper 34*b* is integrally formed with the shaft portion 34*a*. The stopper 34*b* is housed in the guide 31 of the first connection portion 13 in a state in which the shaft portion 34*a* is inserted in the through hole 32 of the first connection portion 13. Also, the upper surface of the stopper 34*b* abuts on the guide 31.

Figure 7:
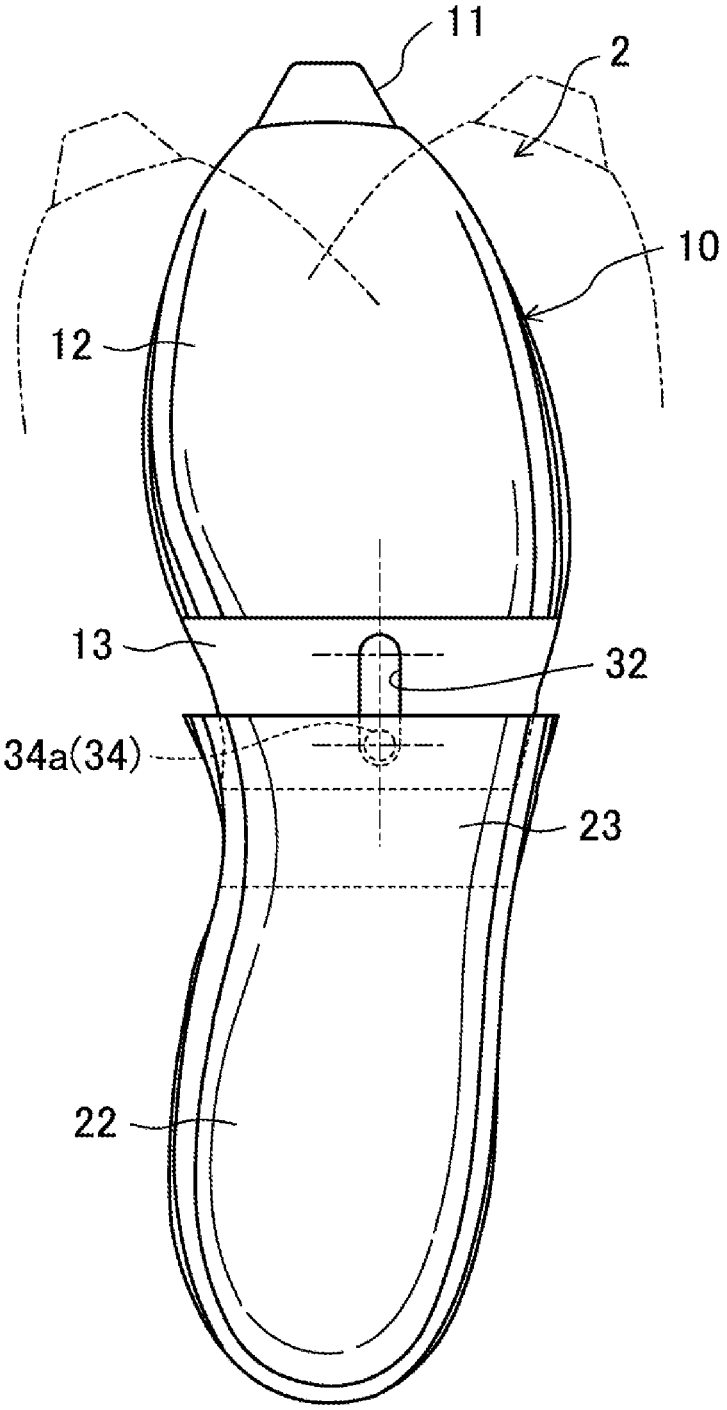
FIG. 7 is a view that corresponds to FIG. 2 and illustrates a state of the sole structure when the first sole portion and the second sole portion relatively move with respect to each other in the foot length direction.

The first connection portion 13 and the second connection portion 23 are connected to each other so as to overlap each other in the vertical direction via the guide 31 and the connecting shaft 34. Specifically, the first connection portion 13 and the second connection portion 23 are connected to each other such that a state in which the upper surface of the first connection portion 13 and the lower surface of the second connection portion 23 face each other in the vertical direction is established. Each of the first connection portion 13 and the second connection portion 23 is relatively movable in the foot length direction. Furthermore, as illustrated in FIG. 7, each of the first connection portion 13 and the second connection portion 23 is configured to turn in the foot width direction about the shaft portion 34*a* of the connecting shaft 34 as a turning shaft (see a virtual line in FIG. 7).

Note that the upper surface of the first connection portion 13 and the lower surface of the second connection portion 23 may contact each other. In this contact state, a lubricant oil or the like is preferably applied between the upper surface of the first connection portion 13 and the lower surface of the second connection portion 23. The lubricant oil can reduce occurrence of excessive friction between the upper surface of the first connection portion 13 and the lower surface of the second connection portion 23.

(Upper)

As illustrated in FIG. 1, the shoe 1 includes an upper 3 that covers the foot of the wearer. The upper 3 is attached to the sole structure 2. The upper 3 is made of, for example, a knit fabric, a woven fabric, a nonwoven fabric, a synthetic leather, an artificial leather, a natural leather, or the like. A foot insertion portion 3*a* in which the foot of the wearer is inserted is provided in an upper portion of the upper 3. As illustrated in FIG. 2, the upper 3 includes an extensible and contractible elastic portion 3*b*, a first fixed portion 3*c*, and a second fixed portion 3*d*.

In the upper 3, the elastic portion 3*b* is arranged in a position that corresponds to a position in which the first connection portion 13 and the second connection portion 23 overlap each other in the vertical direction.

In the upper 3, the first fixed portion 3*c* is arranged in front of a position that corresponds to the first connection portion 13. The first fixed portion 3*c* is firmly fixed to a peripheral portion of the first sole body 12, for example, with a fastening member, such as a string material or the like, or an adhesive.

In the upper 3, the second fixed portion 3*d* is arranged behind a position that corresponds to the second connection portion 23. The second fixed portion 3*d* is firmly fixed to a peripheral portion of the second sole body 22, for example, with a fastening member, such as a string material or the like, or an adhesive.

(Respective Operations of Sole Structure and Upper)

Next, respective operations of the sole structure 2 and the upper 3 according to this embodiment will be described.

As illustrated in FIG. 4, in a state in which the first sole body 12 and the second sole body 22 are close to each other in the foot length direction, a substantially entire portion of the first connection portion 13 and a substantially entire portion of the second connection portion 23 overlap each other in the vertical direction.

In the state illustrated in FIG. 4, for example, in a case in which, when the wearer wears the shoe 1, the elastic portion 3*b* of the upper 3 extends in accordance with the size of the foot of the wearer and the first fixed portion 3*c* moves toward a front of the shoe 1, an external force toward the front of the shoe 1 is transferred to the first sole body 12 via the first fixed portion 3*c*. Then, due to the external force, the first sole body 12 is separated from the second sole body 22 in the foot length direction and the through hole 32 in the guide 31 slides with respect to the shaft portion 34*a* of the connecting shaft 34 in the foot length direction (see FIG. 8).

As another option, in the state illustrated in FIG. 4, for example, in a case in which, when the wearer wears the shoe 1, the elastic portion 3*b* of the upper 3 extends in accordance with the size of the foot of the wearer and the second fixed portion 3*d* moves toward a rear of the shoe 1, an external force toward the rear of the shoe 1 is transferred to the second sole body 22 via the second fixed portion 3*d*. Then, due to the external force, the second sole body 22 is separated from the first sole body 12 in the foot length direction and the shaft portion 34*a* of the connecting shaft 34 slides with respect to the through hole 32 in the guide 31 in the foot length direction (see FIG. 8).

Figure 8:
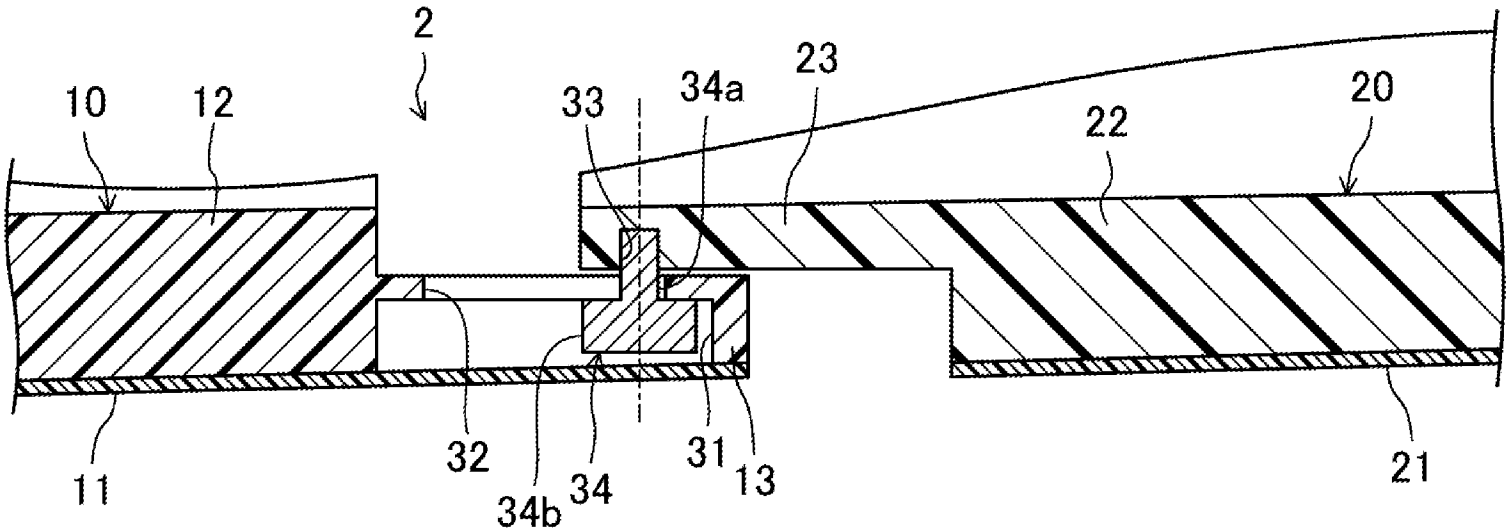
FIG. 8 is a view that corresponds to FIG. 4 and illustrates a state of the sole structure illustrated in FIG. 7.

As illustrated in FIG. 8, in the sole structure 2, even in a state in which one of the first sole body 12 and the second sole body 22 is separated from the other one of the first sole body 12 and the second sole body 22 in the foot length direction, a rear portion of the first connection portion 13 and a front portion of the second connection portion 23 overlap each other in the vertical direction. As described above, each of the first sole portion 10 and the second sole portion 20 is configured such that the first sole body 12 and the second sole body 22 come closer to each other and are separated from each other at least in the foot length direction while a state in which the first connection portion 13 and the second connection portion 23 overlap each other in the vertical direction is maintained.

Working Effects of Embodiments

As described above, in the sole structure 2 according to the embodiment, the first sole body 12 and the second sole body 22 are configured so as to come close to each other and be separated from each other at least in the foot length direction. Therefore, a length of the sole structure 2 at least in the foot length direction can be appropriately changed mainly in accordance with the size of the foot of the wearer. A state in which the first connection portion 13 and the second connection portion 23 overlap each other in the vertical direction is maintained, and therefore, in particular, even in a state in which the first sole body 12 and the second sole body 22 are separated from each other in the foot length direction, a gap is hardly generated between the first sole body 12 and the second sole body 22. Therefore, a foreign matter, water, or the like hardly enters the sole structure 2 from the road surface or the ground. Accordingly, in the sole structure 2 according to the embodiment, at least the length of the sole structure 2 in the foot length direction can be appropriately changed mainly in accordance with the size of the foot of the wearer while the entry of the foreign matter or the like can be prevented. Thus, the wearer can safely and comfortably wear the shoe 1 including the sole structure 2.

Also, the first connection portion 13 and the second connection portion 23 are connected to each other via the connecting shaft 34 so as to overlap each other in the vertical direction and are configured so as to be relatively move with respect to each other at least in the foot length direction. In the above described configuration, it is easy to achieve a configuration in which the first sole body 12 and the second sole body 22 come close to each other and are separated from each other at least in the foot length direction while a state in which the first connection portion 13 and the second connection portion 23 overlap each other in the vertical direction. With the above described simple configuration, similar working effects to the above described working effects can be achieved.

Also, only one connecting shaft 34 is provided and each of the first connection portion 13 and the second connection portion 23 is configured to turn in the foot width direction about the connecting shaft 34 as the turning shaft. Therefore, one of the first sole body 12 and the second sole body 22 relatively moves with respect to the other one of the first sole body 12 and the second sole body 22 also in the foot width direction. Thus, a relative positional relationship between the first sole body 12 and the second sole body 22 is not limited by the size of the foot of the wearer and can be adapted to various operations of the foot of the wearer.

Also, the upper surface of the first sole body 12, the upper surface of the second sole body 22, and the upper surface of the second connection portion 23 are formed as the foot sole support surface that supports the sole of the foot of the wearer and the upper surface of the second connection portion 23 is flush with the upper surface of the first sole body 12 and the upper surface of the second sole body 22. Therefore, the foot sole support surface formed of the upper surface of the first sole body 12, the upper surface of the second sole body 22, and the upper surface of the second connection portion 23 can be entirely made smooth. As a result, the wearer does not feel discomfort in the sole of the foot and the sole of the foot of the wearer can be stably supported.

Also, the first connection portion 13 is arranged under the second connection portion 23 and the first outsole portion 11 (an outsole) is stacked on a lower side of the first connection portion 13. With the first outsole portion 11, entry of a foreign matter, water, or the like to the sole structure 2 through the first connection portion 13 (in particular, the through hole 32) from the road surface or the ground can be prevented.

Also, the upper 3 includes the elastic portion 3*b*, the first fixed portion 3*c*, and the second fixed portion 3*d*. Therefore, when the wearer wears the shoe 1, the elastic portion 3*b* of the upper 3 extends and contracts in accordance with the size of the foot of the wearer and at least one of the first fixed portion 3*c* and the second fixed portion 3*d* moves in the foot length direction. By this movement, at least one of the first sole body 12 and the second sole body 22 is caused to move in the foot length direction and the first connection portion 13 and the second connection portion 23 relatively move with respect to each other in the foot length direction. As described above, the length of the sole structure 2 at least in the foot length direction can be adapted to change of the shape of the upper 3. As a result, the entire shoe 1 can be made fit mainly the size of the foot of the wearer.

First Modified Example of Embodiment

Figure 9:
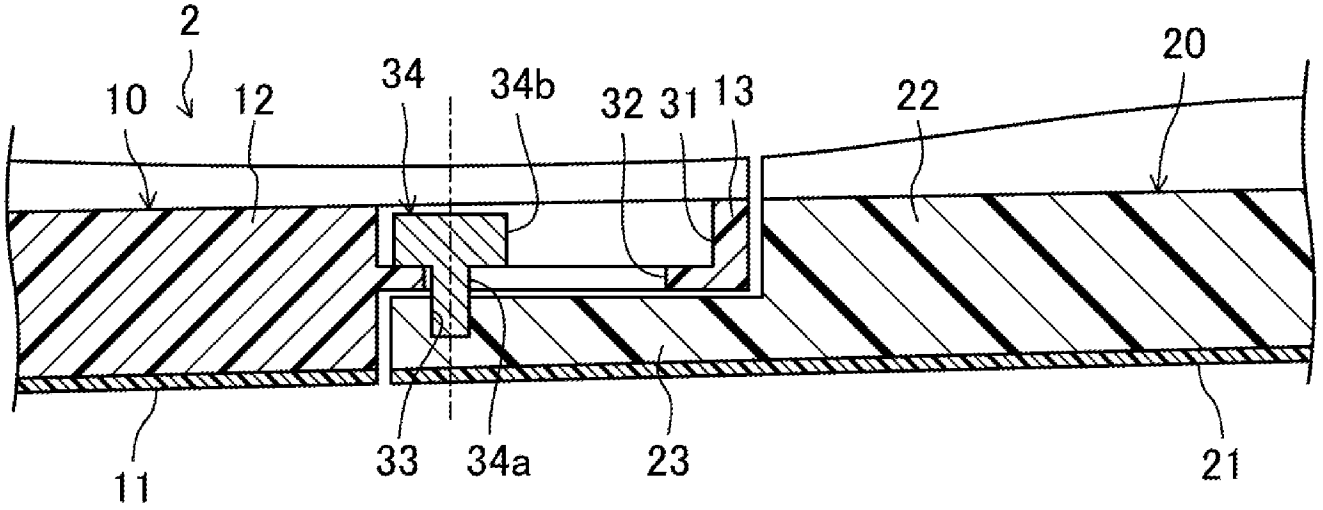
FIG. 9 is a view that corresponds to FIG. 4 and illustrates a first modified example of the shoe according to the embodiment.

In the above described embodiment, a configuration in which the first connection portion 13 is arranged below the second connection portion 23 has been described, but the embodiment is not limited to the configuration. That is, as in a first modified example illustrated in FIG. 9, the first connection portion 13 may be arranged above the second connection portion 23. Furthermore, in the first modified example, similar to the second sole body 22, the second connection portion 23 may be stacked on an upper side of the second outsole portion 21.

Second Modified Example and Third Modified Example of Embodiment

Figure 10:
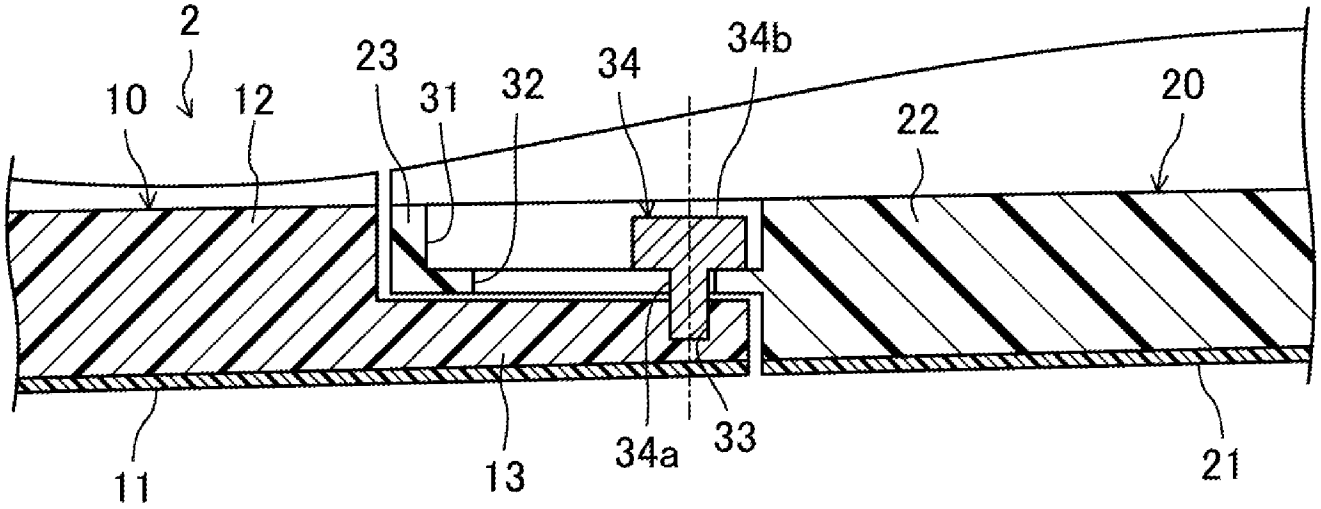
FIG. 10 is a view that corresponds to FIG. 4 and illustrates a second modified example of the shoe according to the embodiment.
Figure 11:
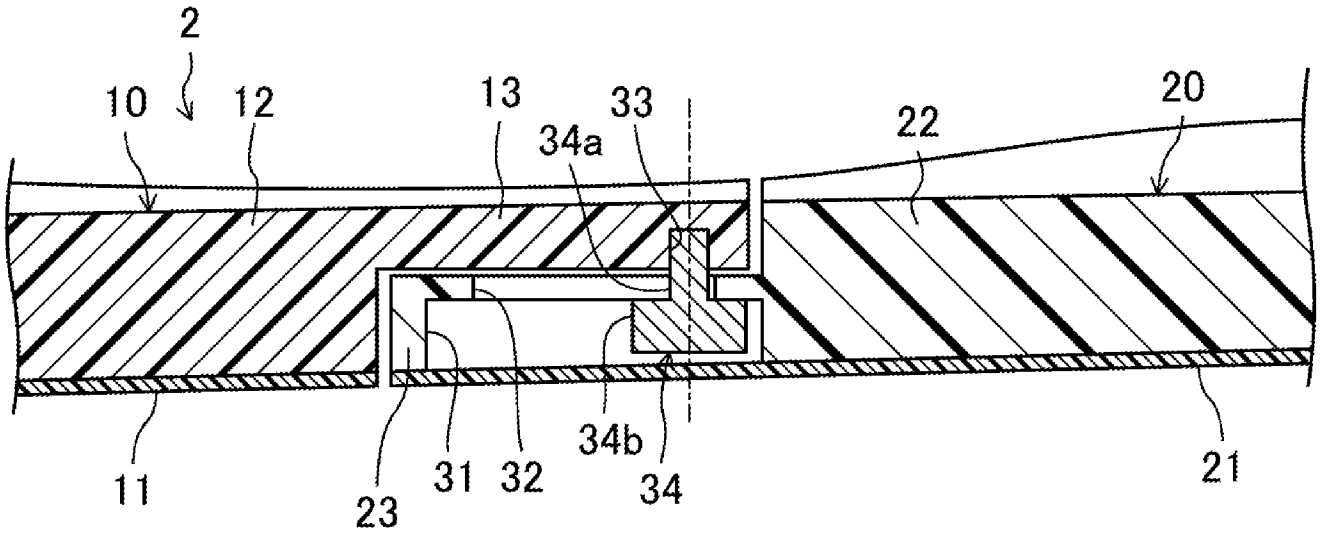
FIG. 11 is a view that corresponds to FIG. 4 and illustrates a third modified example of the shoe according to the embodiment.

Also, in the above described embodiment, a configuration in which, while the guide 31 is provided in the first connection portion 13, the connecting shaft 34 is provided in the second connection portion 23 has been descried, but the embodiment is not limited to the configuration. That is, as in a second modified example illustrated in FIG. 10 and a third modified example illustrated in FIG. 11, while the guide 31 may be provided in the second connection portion 23, the connecting shaft 34 may be provided in the first connection portion 13.

Fourth Modified Example of Embodiment

Figure 12:
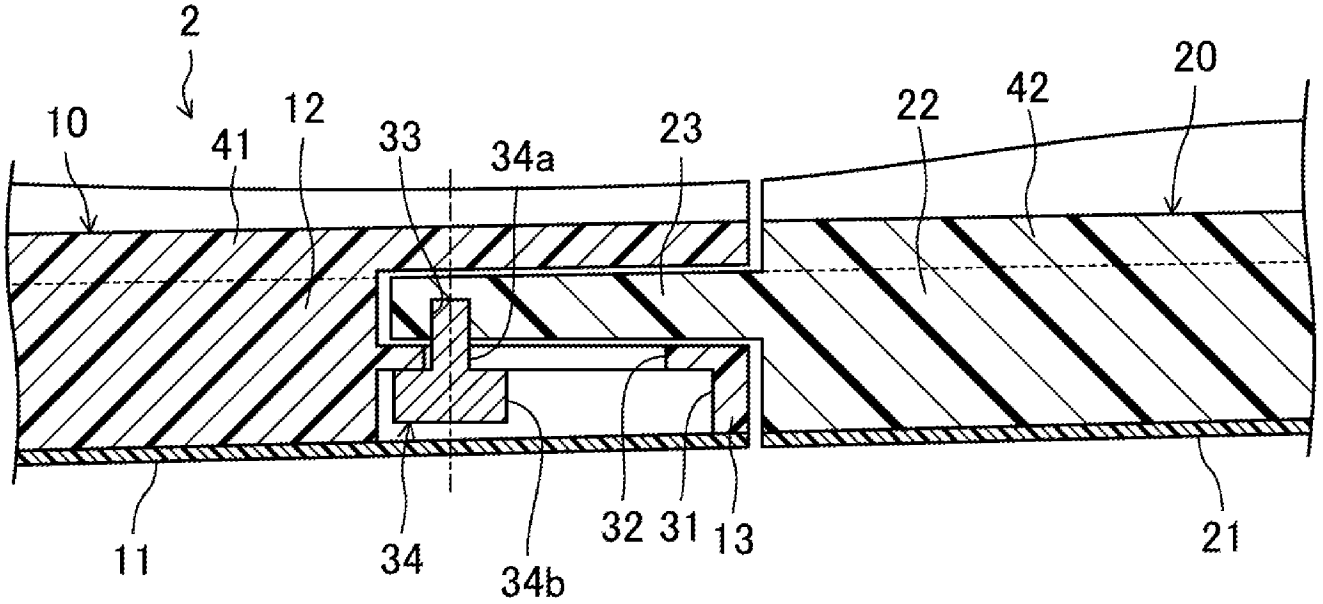
FIG. 12 is a view that corresponds to FIG. 4 and illustrates a fourth modified example of the shoe according to the embodiment.

Also, as in a fourth modified example illustrated in FIG. 12, a configuration in which the sole structure 2 further includes a first upper layer portion 41 and a second upper layer portion 42 may be employed. The first upper layer portion 41 is arranged on an upper side of the first sole body 12 and is integrally formed with the first sole body 12. The first upper layer portion 41 is formed such that a rear portion of the first upper layer portion 41 is located over the second connection portion 23. On the other hand, the second upper layer portion 42 is arranged on an upper side of the second sole body 22 and is integrally formed with the second sole body 22. An upper surface of the first upper layer portion 41 is flush with an upper surface of the second upper layer portion 42.

As described above, in the sole structure 2 of the fourth modified example, each of the first sole portion 10 and the second sole portion 20 is configured such that, while a state in which the first connection portion 13 and the rear portion of the first upper layer portion 41 overlap the second connection portion 23 in the vertical direction is maintained, the first sole body 12 and the second sole body 22 come close to each other and are separated from each other at least in the foot length direction. That is, in the fourth modified example, as compared to the above described embodiment, a configuration in which the rear portion of the first upper layer portion 41 and the second connection portion 23 overlap each other in the vertical direction is further added. Therefore, in the sole structure 2 of the fourth modified example, an advantageous effect of preventing entry of a foreign matter, water, and the like in the sole structure 2 can be further enhanced.

Fifth Modified Example of Embodiment

Figure 13:
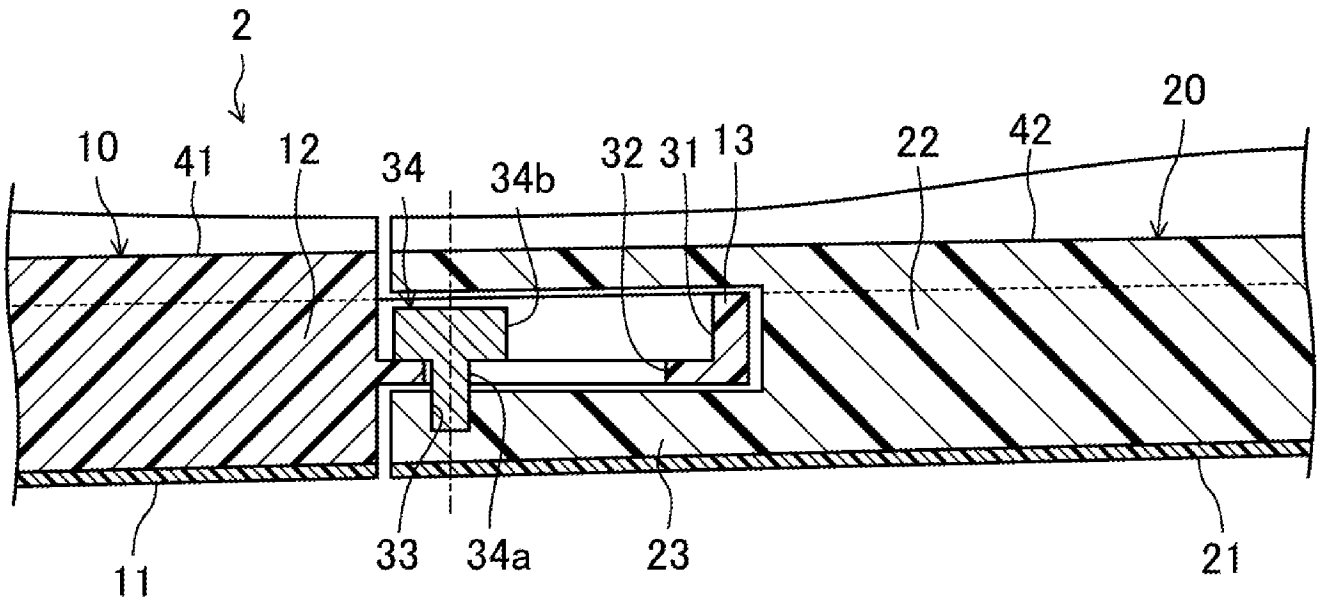
FIG. 13 is a view that corresponds to FIG. 4 and illustrates a fifth modified example of the shoe according to the embodiment.

A fifth modified example illustrated in FIG. 13 is a further modified example in which the first upper layer portion 41 and the second upper layer portion 42 are provided in the sole structure 2 described in the third modified example. That is, in the sole structure 2 of the fifth modified example, each of the first sole portion 10 and the second sole portion 20 is configured such that the first sole body 12 and the second sole body 22 come close to each other and are separated from each other at least in the foot length direction while a state in which the respective front portions of the second connection portion 23 and the second upper layer portion 42 overlap the first connection portion 13 in the vertical direction is maintained. That is, in the fifth modified example, as compared to the above described embodiment, a configuration in which the front portion of the second upper layer portion 42 and the first connection portion 13 overlap each other in the vertical direction is further added. Therefore, even with the sole structure 2 of the fifth modified example, similar to the sole structure 2 of the fourth modified example, the advantageous effect of preventing entry of a foreign matter, water, or the like in the sole structure 2 can be further enhanced.

Sixth Modified Example of Embodiment

In the above described embodiment, a configuration in which the bottomed fixing hole 33 is formed in the second connection portion 23 and the upper portion of the shaft portion 34*a* is firmly fixed in the fixing hole 33 with an adhesive or the like has been described, but the embodiment is not limited to the configuration. For example, a configuration of a sixth modified example illustrated in FIG. 14 may be employed. Even with the sixth modified example, the first connection portion 13 and the second connection portion 23 can be connected to each other via the connecting shaft 34.

Figure 14:
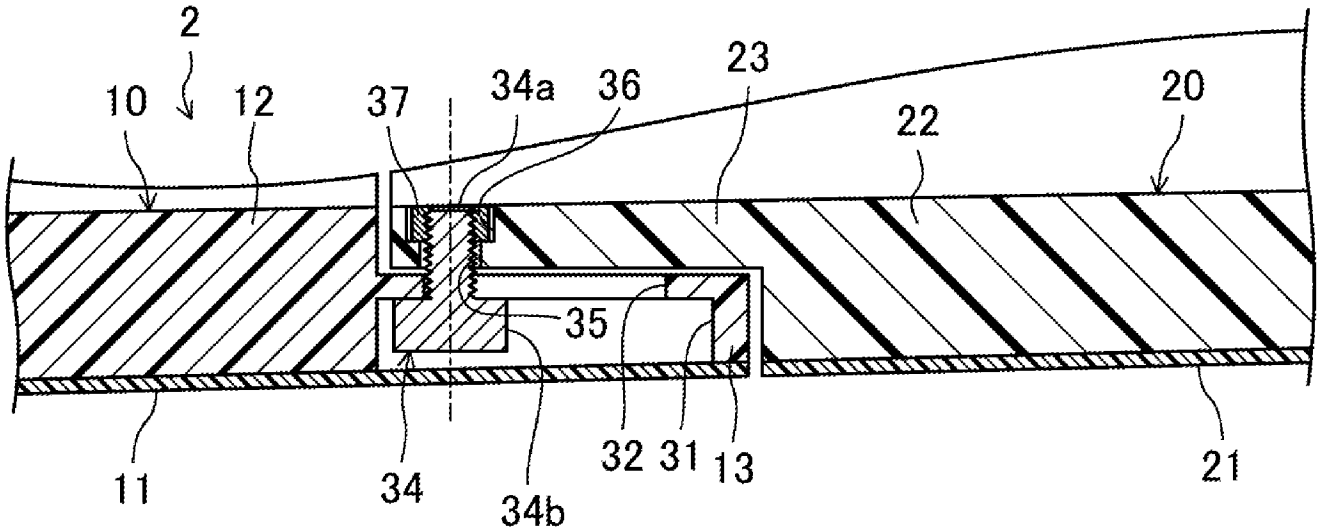
FIG. 14 is a view that corresponds to FIG. 4 and illustrates a sixth modified example of the shoe according to the embodiment.

Specifically, as illustrated in FIG. 14, instead of the fixing hole 33 described in the above described embodiment, a hole portion 35 and a hole portion 36 are formed in the second connection portion 23. The hole portion 35 upwardly passes through from a lower surface of the second connection portion 23. The hole portion 36 is formed downwardly from an upper surface of the second connection portion 23 so as to be bottomed. The hole portion 36 is formed so as to have a larger inner diameter than an inner diameter of the hole portion 35. A nut member 37 is buried in the hole portion 36.

Also, male screw threading has been performed on the shaft portion 34*a* of the connecting shaft 34. The lower portion of the shaft portion 34*a* is inserted through the through hole 32 and the first hole portion 35. The upper portion of the shaft portion 34*a* is screwed to the nut member 37 buried in the hole portion 36. With the above described configuration, the first connection portion 13 and the second connection portion 23 can be connected to each other.

Note that, even in the first to fifth modified examples, the configuration described in the modified example 6 can be applied.

Other Embodiments

In the above described embodiment, a configuration in which the sole structure 2 is divided into two in the foot length direction has been described, but the embodiment is not limited to the configuration. That is, the sole structure 2 may be configured so as to be divided at least two in the foot length direction.

In the above described embodiment, a configuration in which one guide 31, one through hole 32, one fixing hole 33, and one connecting shaft 34 are provided has been described, but the embodiment is not limited to the configuration. That is, a configuration in which a plurality of guides 31, a plurality of through holes 32, a plurality of fixing holes 33, and a plurality of connecting shafts 34 are provided may be employed.

In the above described embodiment, a configuration in which the lower surface of the first sole body 12 and the lower surface of the first connection portion 13 are flush with each other has been described, but the embodiment is not limited to the configuration. That is, the lower surface of the first sole body 12 and the lower surface of the first connection portion 13 may be configured not to be flush with each other. Similar applies to the second modified example and the fourth modified example. Furthermore, in the first modified example, the third modified example, and the fifth modified example, the lower surface of the second sole body 22 and the lower surface of the second connection portion 23 may be configured not to be flush with each other.

In the above described embodiment, a configuration in which the shaft portion 34*a* having a cylindrical shape is used has been described, but the embodiment is not limited to the configuration. For example, the shaft portion 34*a* may be formed to have various shapes, such as a triangular column shape, a quadrangular column shape, or the like. Similar applies to the first to fifth modified examples. Note that, as in the above described embodiment, as long as the shaft portion 34*a* is formed to have a columnar shape, it is easy to cause each of the first connection portion 13 and the second connection portion 23 to turn about the shaft portion 34*a* as a turning shaft in the foot width direction.

Although the embodiments of the present disclosure have been described above, the present disclosure is not limited to the above described embodiments and various modifications and changes can be made to those embodiments within the scope of the present disclosure.

The present disclosure can be industrially applicable, for example, as a sole structure for athletic shoes for running and various sports, sneakers for daily use, or rehabilitation shoes and shoes using the sole structure.

What is claimed is:

1. A sole structure for shoes, comprising:

a first sole portion; and a second sole portion arranged behind the first sole portion, wherein the first sole portion includes a first sole body and a first connection portion provided in a rear portion of the first sole body, the second sole portion includes a second sole body and a second connection portion that is provided in a front portion of the second sole body and is connected to the first connection portion so as to overlap the first connection portion in a vertical direction, each of the first sole portion and the second sole portion is configured such that the first sole body and the second sole body come close to each other and are separated from each other at least in the foot length direction while maintaining a state in which the first connection portion and the second connection portion overlap each other in the vertical direction, only one connection shaft that protrudes in the vertical direction is provided in one of the first connection portion and the second connection portion, the first connection portion and the second connection portion are connected to each other via the connection shaft so as to overlap each other in the vertical direction and are configured to relatively move with respect to each other at least in the foot length direction, and each of the first connection portion and the second connection portion is configured to turn in a foot width direction about the connection shaft as a turning shaft.

2. The sole structure of claim 1, wherein an upper surface of the first sole body, an upper surface of the second sole body, and an upper surface of one of the first connection portion and the second connection portion are formed as a foot sole support surface that supports a sole of a foot of a wearer, and the upper surface of one of the first connection portion and the second connection portion is flush with the upper surface of each of the first sole body and the second sole body.

3. The sole structure of claim 1, wherein the first connection portion is arranged under the second connection portion, and an outsole is stacked on a lower side of the first connection portion.

4. The sole structure of claim 1, wherein the second connection portion is arranged under the first connection portion, and an outsole is stacked on a lower side of the second connection portion.

5. A shoe comprising:

the sole structure of claim 1.

6. The shoe of claim 5, further comprising:

an upper attached to the sole structure, wherein the upper includes an extensible and contractible elastic portion arranged in a position that corresponds to a position in which the first connection portion and the second connection portion overlap each other in the vertical direction, a first fixed portion arranged in front of the first connection portion and firmly fixed to the first sole body, and a second fixed portion arranged behind the second connection portion and firmly fixed to the second sole body.

* * * * *